US006221823B1

(12) United States Patent
Crisanti et al.

(10) Patent No.: US 6,221,823 B1
(45) **Date of Patent: *Apr. 24, 2001**

(54) GERMICIDAL, ACIDIC HARD SURFACE CLEANING COMPOSITIONS

(75) Inventors: Michael George Crisanti, Danbury, CT (US); Robert Zhong Lu, Hasbrouck Heights, NJ (US); Robert Paul Manzo, Goshen, NY (US); Gary Peter Kline, Irwin, PA (US)

(73) Assignee: Reckitt Benckiser Inc., Wayne, NJ (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/709,759

(22) Filed: Sep. 9, 1996

(30) Foreign Application Priority Data

Oct. 25, 1995 (GB) ..... 9521829
Jun. 17, 1996 (GB) ..... 9612645

(51) Int. Cl.[7] ..... C11D 1/37; C11D 3/44

(52) U.S. Cl. ..... 510/238; 510/239; 510/403; 510/426; 510/488; 510/506

(58) Field of Search ..... 510/362, 191, 510/145, 199, 238, 239, 403, 426, 488, 506; 134/40, 42, 41

(56) References Cited

U.S. PATENT DOCUMENTS 4,020,016 * 4/1977 Sokol ..... 252/546
4,501,680 * 2/1985 Aszman et al. ..... 252/142
4,557,853 * 12/1985 Collins ..... 252/128
4,692,276 * 9/1987 Schramm ..... 252/545
4,915,854 * 4/1990 Mao et al. ..... 252/8.8

(List continued on next page.)

FOREIGN PATENT DOCUMENTS

WO95/18210 A1 7/1995 (WO) .

OTHER PUBLICATIONS

Copy of GB Search Report for Application No. GB 9612645.3 dated Nov. 1, 1996.

Copy of PCT Search Report dated Feb. 21, 1997 for PCT/US96/15463.

*Primary Examiner*—Yogendra Gupta
*Assistant Examiner*—Gregory E. Webb
(74) *Attorney, Agent, or Firm*—Fish & Richardson P.C.

(57) ABSTRACT

Improved hard surface cleaning compositions having an acidic pH provide good removal of soap scum stains, and further feature low levels of irritability to the user. The compositions comprise 0.1–10% by weight of an acid sequestrant constituent;

0.1–10% by weight of a mixture of hydrophobic and hydrophilic solvents;

1–8% by weight of a surfactant and/or hydrotrope constituent;

0–20% by weight of one or more optional constituents;

the balance to 100% by weight, water wherein the aqueous hard surface cleaning composition exhibits a pH of 7.0 or less, especially a pH of 5.0 and less. Although acidic, the improved hard surface cleaning compositions feature low irritability to the eyes and skin of consumers. The compositions also provide disinfecting effects. Processes for the production of the said compositions, as well as methods for their use are also described.

11 Claims, 2 Drawing Sheets

U.S. PATENT DOCUMENTS

| | | | | |
|---|---|---|---|---|
| 5,061,393 | | 10/1991 | Linares et al. | 252/143 |
| 5,075,026 | | 12/1991 | Loth et al. | 252/122 |
| 5,076,954 | | 12/1991 | Loth et al. | 252/122 |
| 5,082,584 | | 1/1992 | Loth et al. | 252/122 |
| 5,108,643 | | 4/1992 | Loth et al. | 252/174.11 |
| 5,192,460 | * | 3/1993 | Thomas et al. | 252/142 |
| 5,202,050 | * | 4/1993 | Culshaw et al. | 252/170 |
| 5,232,632 | | 8/1993 | Woo et al. | 252/546 |
| 5,254,290 | * | 10/1993 | Blandiaux et al. | 252/545 |
| 5,281,354 | | 1/1994 | Faber | 252/154 |
| 5,290,472 | | 3/1994 | Michael | 252/170 |
| 5,362,422 | * | 11/1994 | Masters | 252/544 |
| 5,370,817 | * | 12/1994 | Weltman et al. | 252/170 |
| 5,384,063 | | 1/1995 | Woo et al. | 252/142 |
| 5,399,280 | * | 3/1995 | Woo et al. | 252/142 |
| 5,453,276 | * | 9/1995 | Nakatsu et al. | 424/405 |
| 5,612,308 | * | 3/1997 | Woo et al. | 510/423 |
| 5,653,991 | * | 8/1997 | Rod | 424/406 |
| 5,656,580 | * | 8/1997 | Carrie et al. | 510/362 |

* cited by examiner

GERMICIDAL, ACIDIC HARD SURFACE CLEANING COMPOSITIONS

This application claims priority from provisional from Great Britain Application 9521829.3 filed Oct. 25, 1995 and Great Britain Application 9612645.3 filed Jun. 17, 1996.

The present invention relates to improvements in cleaning compositions. More particularly the present invention is directed to improved cleaning compositions which find particular use in hard surface cleaning applications.

Cleaning compositions are commercially important products and enjoy a wide field of utility in assisting in the removal of dirt and grime from surfaces, especially those characterized as useful with "hard surfaces". Hard surfaces are those which are frequently encountered in lavatories such as lavatory fixtures such as toilets, shower stalls, bathtubs, bidets, sinks, etc., as well as countertops, walls, floors, etc. In such lavatory environment various forms of undesirable residues are known to form including hard water stains as well as "soap scum stains". Hard water stains are mineral stains caused by the deposition of salts, such as calcium or magnesium salts, frequently present in hard water; soap scum stains are residues of fatty acid soaps such as soaps which are based on alkaline salt of low fatty acids, which fatty acids are known to precipitate in hard water due to the presence of metal salts therein leaving an undesirable residue upon such surfaces. Various formulations in compositions of cleaning agents have been produced and are known to the art which cleaning agents are generally suited for one type of stain but not necessarily for both classes of stains. For example, it is known to the art that highly acidic cleaning agents comprising strong acids, such as hydrochloric acids, are useful in the removal of hard water stains. However, the presence of strong acids is known to be an irritant to the skin and further offers the potential of toxicological danger. Other classes of cleaning compositions and formulations are known to be useful upon soap scum stains, however, generally such compositions comprise an organic and/or inorganic acid, one or more synthetic detergents from commonly recognized classes such as those described in U.S. Pat. No. 5,061,393; U.S. Pat. No. 5,008,030; U.S. Pat. No. 4,759,867; U.S. Pat. No. 5,192,460; U.S. Pat. No. 5,039,441. Generally, the compositions described in these patents are claimed to be effective in the removal of soap scum stains from such hard surfaces and may find further limited use in other classes of stains. However, the formulations of most of the compositions within the aforementioned patents generally have relatively high amounts of acids (organic and/or inorganic) which raises toxicological concerns, and further none of the above patents provide any disinfecting properties.

Compositions are known to the art which do provide disinfection and sanitization through the use of certain classes of anionic surfactants coupled with an acidic component such as that described in U.S. Pat. No. 5,143,720. However, the compositions in this U.S. patent would not be expected nor are believed to provide any significant cleaning benefit and thus would not be particularly effective in the removal of residues, particularly hard water stains and soap scum stains.

Thus, it is among the objects of the invention to provide improved cleaning compositions which are effective in providing a disinfecting effect and facilitate in the removal of soap scum stains and hard water stains, especially from hard surfaces.

It is a further object of the invention to provide improved cleaning compositions which provide the benefits of low toxicity, and hard water stain removal and soap scum stain removal.

It is a still further object of the invention to provide improved cleaning compositions which are particularly effective in hard water stain removal and soap scum stain removal, and which further features minimal irritability to the eyes, skin or mucocus tissues of a consumer.

It is yet a further object of the invention to provide a readily pourable and readily pumpable cleaning composition which features the benefits described above.

It is a further object of the invention to provide a process for the improvement of the simultaneous cleaning and sanitization of hard surfaces, which process comprises the step of: providing a cleaning composition as outlined above, and applying an effective amount to a hard surface requiring such treatment.

These and other objects of the invention shall be more apparent from a reading of the specification and of the claims attached.

Figure 1:
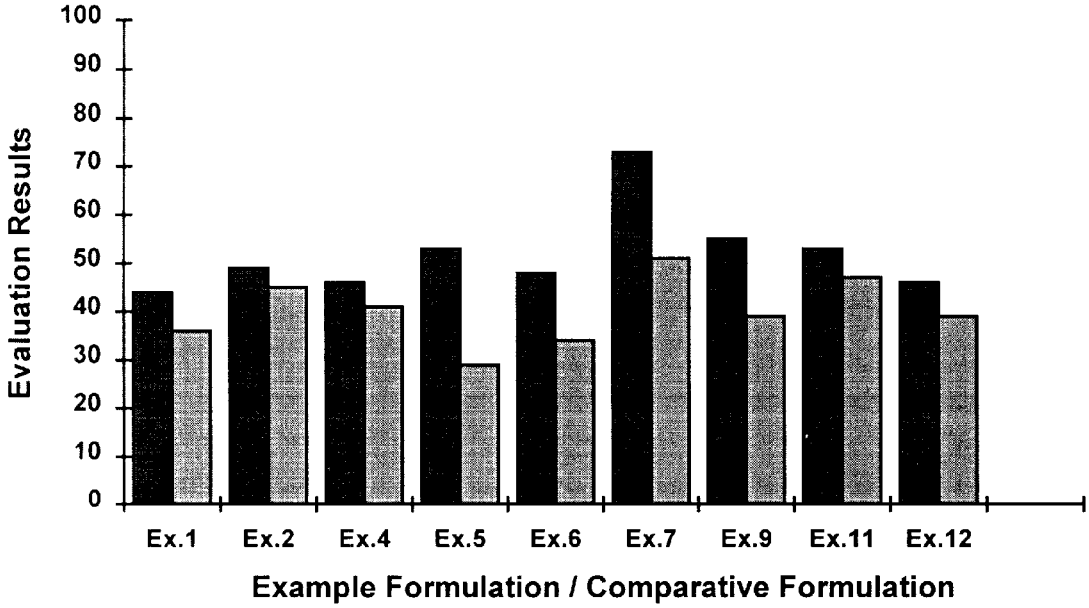
FIG. 1 Provides a graphical depiction of visual cleaning evaluation results of table 4.

According to the invention, there are provided aqueous hard surface cleaning composition which comprises the following necessary constituents:

| | |
|---|---|
| Constituent (A) | acid sequestrant; |
| Constituent (B) | mixture of hydrophobic and hydrophilic solvents; |
| Constituent (C) | surfactant and/or hydrotrope, |

The compositions of the invention may also include one or more further optional constituents such as known art additives. By way of non-limiting example, such constituents include: further surfactants, particularly surfactants which are useful for the removal of greasy soils, foaming agents and foam stabilizers, coloring agents, including dyes and pigment compositions, fragrances (whether natural or synthetically produced), fragrance adjuvants and/or fragrance solubilizers, viscosity modifying agents including thickeners or gelling agents, pH adjusting agents, pH buffers, antioxidants, water softening agents, further solubilizing agents which might be useful in the solubilization of one or more of the constituents in water, preservative compositions, as well as other known art additives not particularly elucidated here. Such constituents as described above include known art compositions, including those described in *McCutcheon's Detergents and Emulsifiers,* North American Edition, 1991; *Kirk-Othmer, Encyclopedia of Chemical Technology,* 3rd Ed., Vol. 22, pp. 346–387, the contents of which are herein incorporated by reference.

The compositions according to the invention are preferably acidic in character, exhibiting a pH of less than 7.0 Most desirably, the pH of the inventive compositions are in the range of from about 5.0 to about 1.0 and still more desirably exhibits a pH in the range of about 4.0 to about 1.0 and most desirably exhibits a pH in the range of about 3.0 to about 1.0 and less.

In accordance with a further aspect of the invention, there is also provided an improved method for the cleaning of surfaces, particularly those surfaces known to the art as hard surfaces which includes the step of applying a stain releasing effective amount of a composition as taught herein to such a stained surface.

In a further aspect of the invention, there is also provided improved process for cleaning and disinfecting surfaces especially hard surfaces which includes the step of applying to the surface a stain releasing and disinfecting effective amount of a composition as taught herein to such a stained surface.

Constituent A The constituents which comprise Constituent A, namely the acid sequestrant according to the invention may be any acid which is found to be effective in the removal of hard water stains from hard surfaces, particularly lavatory surfaces as denoted above. Exemplary useful acids include: citric acid, cresylic acid, dodecylbenzene sulfonic acid, phosphoric acid, salicylic acid, sorbic acid, sulfamic acid, acetic acid, benzoic acid, boric acid, capric acid, caproic acid, cyanuric acid, dihydroacetic acid, dimethylsulfamic acid, propionic acid, polyacrylic acid, 2-ethylhexanoic acid, formic acid, fumaric acid, 1-glutamic acid, isopropyl sulfamic acid, naphthenic acid, oxalic acid, phosphorus acid, valeric acid, benzene sulfonic acid, xylene sulfonic acid, as well as any acid listed as a registered pesticide active ingredient with the United States Environmental Protection Agency. Further useful acids include: sulfonic acids, maleic acid, acetic acid, adipic acid, lactic acid, butyric acid, gluconic acid, malic acid, tartaric acid, as well as glycolic acid. Desirably glycolic acid and citric acid are used as they are effective and in plentiful supply. The acids which comprise Constituent A may be used singly or in conjunction with one another, as combinations of two or more acids are, of course, possible and the selection of the acids may be, in part, based upon their determined adequacy upon hard water stains.

The acid sequestrants according to Constituent A provide several functional attributes to the compositions according to the invention. First, they provide free acidity within the cleaning composition which free acid reacts with the fatty acid metal salts which are comprised within soap scum stains releasing the metal ions and freeing the fatty acid. Such an action facilitates the removal of these undesired stains from hard surfaces. A second functional attribute of these components is that they provide sequestration of the resulting free metal ions which are released from the soap scum stains. Further, in the case where the constituents of Constituent A are selected to include one or more acids which feature disinfecting properties, they concomitantly provide requisite anti-microbial activity necessary to disinfect the cleaned surface.

Preferably Constituent A comprises citric acid with at least one further acid described above, as it has been observed by the inventor that citric acid provides good disinfecting action in the compositions of the invention but in certain formulations may be insufficiently acidic in order to effectively remove certain stains. The addition of at least one further acid provides additional cleaning effect which was not observed in certain formulations with citric acid alone.

The acid sequestrants of Constituent A are desirably present in the formulations in ranges of from 0.1 to 10% by weight, preferably from 1.0 to 8.0% by weight and more preferably from 4.0 to 6.0% by weight, based on the total weight of a composition formed in accordance with the present inventive teaching. In preferred embodiments however, citric acid comprises at least 0.1% by weight of the total weight of the acids of Constituent A, more preferably citric acid comprises at least 25% by weight, and most preferably citric acid comprises at least 50% by weight of the acids of Constituent A.

Constituent B The constituents comprising Constituent B, namely, a mixture of hydrophobic and hydrophilic solvents, are directed to providing the functional benefit of assisting in the dissolution of the fatty acids from a surface being cleaned with the inventive compositions. Such fatty acids presently in the soap scum residues are solubilized and/or rendered at least partially miscible in water due to the presence of Constituent B, which feature facilitates the removal of the stain from the surface. A further functional attribute of constituents of Constituent B is that the hydrophobic and/or hydrophilic solvents are useful in penetrating the stain and act as a carrier for the further constituents of the invention, especially the constituents comprising Constituent A thus bringing them through the layer of the stain to the surface upon which the stain is present, and thereby aiding in the effective dissolution of said stain and its removal.

With regards to the hydrophobic solvent constituent of Constituent B, the hydrophobic solvent should be a solvent which demonstrates solubilization of the aliphatic portions of the fatty acids comprised within the soap scum stains. Such a requirement is effective in aiding the dissolution of the stain and the penetration of the component through the stain and to the interfacial boundary layer with the surface. By way of non-limiting example, useful hydrophobic solvents which find use in the present inventive compositions include: mineral spirits, tripropylene glycol n-butyl ether, propylene glycol phenyl ether, dipropylene glycol n-propyl ether, ethylene glycol phenyl ether, and particularly propylene glycol n-butyl ether, dipropylene glycol n-butyl ether. Other hydrophobic solvents exhibiting the characteristics denoted above and known to the art may also be utilized. The hydrophobic solvent may be one such solvent, or a mixture of two or more hydrophobic solvents.

The hydrophilic solvent of Constituent B may be any hydrophilic solvent which is useful in solubilizing or improving the miscibility of the hydrophobic solvent in water. It is to be understood that where the hydrophobic solvent of Constituent B acts to dissolve the soap fatty acids, the hydrophilic solvent acts to solubilize the hydrophobic solvent in water, and thereby provides effective solubility with the aqueous phase thus facilitating the removal of the hydrophobic solvent and dissolved soap fatty acids from the surface being cleaned.

With reference to the hydrophilic solvent, by way of non-limiting example, useful hydrophilic solvents include certain alcohols, glycols, acetates, ether acetates and glycol ethers including propylene glycol methyl ether, dipropylene glycol methyl ether, tripropylene glycol methyl ether, propylene glycol n-propyl ether, ethylene glycol n-butyl ether, diethylene glycol n-butyl ether, diethylene glycol methyl ether, propylene glycol, ethylene glycol, isopropanol, ethanol, methanol, diethylene glycol monoethyl ether acetate and particularly advantageously ethylene glycol monobutyl ether acetate. Others not particularly elucidated here, but which exhibit the functional characteristics described herein may also be used, and of course, two or more hydrophilic solvents may be used as a mixture.

The hydrophobic solvent desirably exhibits a solubility in water of between 0.0 ml/100 ml and 20.0 ml/100 ml and further should comprise between 50 to 99% of the total weight of Constituent B within the compositions according to the invention. More preferably, the hydrophobic solvent should comprise between 60–95%, most preferably between 80–90% of the total weight of Constituent B of the compositions according to the invention.

The hydrophilic solvents comprising Constituent B of this invention should exhibit good solubility in water, i.e., approaching or demonstrating "infinite solubility" and should preferably be comprised within the compositions that are in a weight percentage of between 1–50%, preferably 1–40%, still more preferably between 5–30%, and most preferably between 10–20% based on the total weight of Constituent B within the compositions according to the invention.

With regard to the effective amounts of Constituent B, Constituent B is desirably present between about 0.1–10% by weight based on the total cleaning composition weight, preferably between about 2.0–8.0% by weight, and more preferably 3.0–6.0% by weight.

Constituent C The constituents comprising Constituent C according to the invention provide several functional features thereto. One functional feature of Constituent C is surfactant qualities, i.e., the reduction of the interfacial tension between the soil and the compositions of the invention which facilitates the wetting of the stain and facilitating the transport of the constituents of the cleaning composition throughout the stain and to the interfacial surface between the stain and the surface; such action provides effective distribution of the cleaning composition within the stain itself. A second functional feature provided by Constituent C of the invention is the hydrotropic functionality. Such a hydrotropic functionality facilitates the solubilization of greater amounts of fatty acids of the stain, thus enhancing the ability of the cleaning composition and the removal of such stains.

Exemplary constituents which may be used in Constituent C of the instant include, but are not limited to: alkyl phenoxy benzene disulfonates, linear alkyl benzene sulfonates and alkylnaphtalene sulfonates and salts thereof. Such compositions are known to the art, and are presently commercially available as anionic surface active agents, also referred to as anionic surfactants. These include but are not limited to: alkali metal salts, ammonium salts, amine salts, aminoalcohol salts or the magnesium salts of one or more of the following compounds: alkyl sulfates, alkyl ether sulfates, alkylamidoether sulfates, alkylaryl polyether sulfates, monoglyceride sulfates, alkylsulfonates, alkylamide sulfonates, alkylarylsulfonates, olefinsulfonates, paraffin sulfonates, alkyl sulfosuccinates, alkyl ether sulfosuccinates, alkylamide sulfosuccinates, alkyl sulfosuccinamate, alkyl sulfoacetates, alkyl phosphates, alkyl ether phosphates, acyl sarcosinates, acyl isethionates, and N-acyl taurates. Generally, the alkyl or acyl radical in these various compounds comprise a carbon chain containing 12 to 20 carbon atoms.

Exemplary alkyl phenoxy benzene disulfonates include metal salts and organic salts of alkylphenoxy benzene disulfonates, such as sodium dodecyl diphenyloxide disulfonate, sodium hexyl diphenyloxide disulfonate, sodium n-decyl diphenyloxide disulfonate, as well as sodium n-hexadecyl diphenyloxide disulfonate. Other metal counterions or organic counterions may be substituted in the place of the sodium noted in the recited alkyl phenoxy benzene disulfonates noted above, as well as mixtures of two or more alkyl phenoxy benzene disulfonates.

Exemplary linear alkyl benzene sulfonates include metal salts and organic salts of linear alkyl benzene sulfonates, such as sodium dodecylbenzene sulfonate, sodium nonylbenzene sulfonate, isopropylamine salts of linear alkyl benzene sulfonic acid, triethanolamine dodecylbenzene sulfonate, diethanolamine dodecylbenzene sulfonate, potassium dodecylbenzene sulfonate, sodium tridecylbenzene sulfonate, as well as mixtures of sodium dodecylbenzenesulfonate with sodium toluene sulfonate, sodium cumene sulfonate and/or with sodium xylene sulfonate. Other metal counterions or organic counterions may be substituted in the place of the counterions noted in the recited linear alkyl benzene sulfonates noted above, as well as mixtures of two or more linear alkyl benzene sulfonates.

Exemplary alkylnaphthalene sulfonates include metal salts and organic salts of alkylnapthalene sulfonates such as sodium diisopropylnaphthalene sulfonate, butylnaphthalene sodium sulfonate, nonylnaphthalene sodium sulfonate, sodium dibutylnaphthalene sulfonate, sodium dimethylnaphthalene sulfonate and sodium dimethylnaphthalene sulfonate. Other metal counterions or organic counterions may be substituted in the place of the counterions noted in the recited alkylnaphthalene sulfonates noted above, as well as mixtures of two or more alkylnaphthalene sulfonates.

Further useful as constituents used in Constituent C include sodium xylene sulfonate, sodium cumene sulfonate, and naphthalene sulfonates.

Most desirably, the constituents used in Constituent C for use in the present invention should be selected in order to possess both surfactant and hydrotropic properties.

It should be appreciated that Constituent C may be one or more constituents, i.e., a single constituent which exhibit satisfactory surfactant and hydrotropic properties, or two or more individual constituents where one or more constituents exhibits satisfactory surfactant properties, but insufficient or unsatisfactory hydrotropic properties, and where other or others exhibit satisfactory hydrotropic properties or insufficient or unsatisfactory surfactant properties. Thus, single constituent and multiple constituent combinations of Constituent C are contemplated within the scope of this invention.

With regard to the effective amounts of Constituent C, Constituent C is desirably present between about 1.0–8.0% by weight based on the total cleaning composition weight, preferably between about 2.0–6.0% by weight, and more preferably 2.0–4.0% by weight.

As is noted above, the compositions according to the invention are aqueous in nature. Water is added to Constituents A, B and C in order to provide 100% by weight of the composition. The water may be tap water, but is preferably distilled and is most preferably deionized water. If the water is tap water, it is preferably substantially free of any undesirable impurities such as organics or inorganics, especially minerals salts which are present in hard water which may thus interfere with the operation of Constituents A, B, C, as well as any other optional components of the aqueous compositions according to the invention.

The compositions according to the invention may comprise one or more of the following optional components, the total weight of such optional constituents not exceeding about 20% by weight of the total weight of the composition, more preferably not exceeding about 10% by weight and is most preferably less than 10% by weight based on the total weight of the composition according to the invention.

Non-ionic surfactants of the conventionally known and used variety in this class of cleaning agents may be added in effective amounts, i.e., amounts which are shown to be effective in the cleaning compositions in facilitating the removal of greasy soils. Such greasy soils are to be differentiated from the hard water stains and the soap scum stains described earlier in this specification. However, it is also to be appreciated that the non-ionic surfactants of this optional constituent may be also at least partially effective in the solubilization and removal of soap scum stains. Exemplary further nonionic surfactants include known nonionic surfactants which generally consist of a hydrophobic moiety, such as $C_8$–$C_{20}$ primary or secondary, branched or straight chain monoalcohols, $C_8$–$C_{18}$ mono- or dialkyphenols, $C_6$–$C_{20}$ fatty acid amides, and a hydrophilic moiety which consists of alkylene oxide units. These nonionic surfactants are for instance alkoxylation products of the above hydrophobic moieties, containing from 2 to 30 moles of alkylene oxide. As alkylene oxides ethylene-, propylene- and butylene oxides and mixtures thereof are used.

Typical examples of such nonionic surfactants are $C_9$–$C_{11}$ primary, straight-chain alcohols condensed with 5–9 moles of ethylene oxide, $C_{12}$–$C_{15}$ primary straight-chain alcohols condensed with from 6–12 moles of ethylene oxide, or with 7–9 moles of a mixture of ethylene oxide and propylene oxide, $C_{11}$–$C_{15}$ secondary alcohols condensed with from 3–15 moles of ethylene oxide, and $C_{10}$–$C_{18}$ fatty acid diethanolamides, and tertiary amine oxides such as higher alkyl di(lower alkyl or lower substituted alkyl)amine oxides. Such nonionic surfactants are known to the art, and are more particularly described in *McCutcheon's Detergents and Emulsifiers,* noted above.

Foaming agents, and foam stabilizing agents may be provided. As is known to the art, it is frequently commercially desirable to the compositions according to the invention. Such may be especially desirable where the composition is packaged in a pressurized device, i.e., an aerosol canister or in a hand-held pumpable container (such as a hand held trigger spraying vessel), so that upon the application of the composition to the stain a foaming action is observed by the consumer/end user. When dispensed onto a surface, known foaming agents may be used including the following exemplary compositions: alkyl sulfates, alkyl sulfonates, amine oxides, as well as alkanolamides, as well as others known to the art.

Further optional, but desirable constituent include fragrances, natural or synthetically produced. Such fragrances may be added in any conventional manner, admixing to a composition or blending with other constituents used to form a composition, in amounts which are found to be useful to enhance or impart the desired scent characteristic to the composition, and/or to cleaning compositions formed therefrom.

In compositions which include a fragrance, it is frequently desirable to include a fragrance solubilizer which assists in the dispersion, solution or mixing of the fragrance constituent in an aqueous base. These include known art compounds, including condensates of 2 to 30 moles of ethylene oxide with sorbitan mono- and tri-$C_{10}$–$C_{20}$ alkanoic acid esters having a HLB of 8 to are also known as nonionic surfactants. Further examples of such suitable surfactants include water soluble nonionic surfactants of which many are commercially known and by way of non-limiting example include the primary aliphatic alcohol ethoxylates, secondary aliphatic alcohol ethoxylates, alkylphenol ethoxylates and ethylene-oxide-propylene oxide condensates on primary alkanols, and condensates of ethylene oxide with sorbitan fatty acid esters. This fragrance solubilizer component is added in minor amounts, particularly amount which are found effective in aiding in the solubilization of the fragrance component, but not in any significantly greater proportion, such that it would be considered as a detergent constituent. Such minor amounts recited herein are generally up to about 0.5% by weight of the total composition but is more generally an amount of about 0.1% by weight and less, and preferably is present in amounts of about 0.05% by weight and less.

Further optional, but advantageously included constituents are one or more coloring agents which find use in modifying the appearance of the compositions and enhance their appearance from the perspective of a consumer or other end user. Known coloring agents, may be incorporated in the compositions in any effective amount to improve or impart to compositions a desired appearance or color. Such a coloring agent or coloring agents may be added in a conventional fashion, i.e., admixing to a composition or blending with other constituents used to form a composition.

The use of one or more pH adjusting agents, including agents known to the art such a minor amounts of mineral acids, basic compositions, and organic acids may be used. An exemplary composition includes citric acid, such as is available in an anhydrous salt form of an alkali metal citric acid. The addition of an effective amount such a pH adjusting agent is useful in establishing a targeted pH range for compositions according to the invention.

The addition of an effective amount of a pH buffering composition so to maintain the pH of the inventive compositions may also be added. While the composition of the invention generally does not require a pH buffering composition, the use of such a pH buffering composition may provide the benefit of hard water ion sequestration, should the inventive composition be diluted with further water by the consumer or other end user. Any pH buffering compound or pH buffer composition which is compatible with the aqueous compositions taught herein may be used, and many of these are well known to the art. Examples of such useful pH buffer compounds and/or pH buffering systems or compositions the alkali metal phosphates, polyphospates, pyrophosphates, triphosphates, tetraphosphates, silicates, metasilicates, polysilicates, carbonates, hydroxides, and mixtures of the same. Certain salts, such as the alkaline earth phosphates, carbonates, hydroxides, can also function as buffers. It may also be suitable to use buffers such materials as aluminosilicates (zeolites), borates, aluminates and certain organic materials such as gluconates, succinates, maleates, and their alkali metal salts. Such buffers keep the pH ranges of the compositions of the present invention within acceptable limits. Others, not particularly elucidated here may also be used. Preferably, citric acid, such as is available in an anhydrous salt form of an alkali metal citric acid is added as it is readily commercially available, and effective. The addition of such a buffering agent is desirable in certain cases wherein long term, i.e., prolonged storage, is to be anticipated for a composition, as well as insuring the safe handling of said aqueous composition.

Preservatives may also be added in minor amounts in the formulations according to the invention which preservative compositions do not include a disinfectant component. Known art compositions may be used. Examples of such preservatives compounds include those which are presently commercially available under the tradenames Kathon® CG/ICP (Rohm & Haas, Philadelphia Pa.), Suttocide® A (Sutton Labs, Chatham N.J.) as well as Midtect® TFP (Tri-K Co., Emerson, N.J.). Such preservative compositions are generally added in only minor amounts, i.e., amounts of about 0.5% by weight of the total composition, more generally an amount of about 0.1% by weight and less, and preferably is present in amounts of about 0.05% by weight and less.

Thickening and/or gelling agents may be added to the hard surface cleaning compositions according to the present invention in order to modify the viscous and/or thixatropic properties thereof. For example, in certain applications it is contemplated that it may be desirable to provide a more viscous, viz., higher viscosities than that of water, whether for esthetic or functional reasons. For example, the addition of a suitable amount of a gelling agent may be desired not only for aesthetic reasons but also to limit the spreading of the composition as it is applied to a surface. This function is desirable in providing a means to apply the composition over a limited area, such as directly onto a stain, without applying an excess onto the surrounding area of a surface. This function also aids in the surface retention time on non-horizontal surface, ensuring that the cleaning composition is in contact with a stained surface without flowing off too rapidly. Similarly, thixatropic properties may also be desired under certain circumstances. In order to provide such functional features to the composition, known thickening and gelling agents including, but not limited to, cellulose compounds, xanthan gums, polymers and/or clays may be added.

The benefits of the compositions described in this specification include particularly: disinfection, good removal of hard water stains, good removal of soap scum stains, relatively low toxicity, as well as ease in handling of the composition due to its readily pourable or pumpable characteristic. Further, when one or more of the optional constituents is added, i.e., fragrance, foaming agents, coloring agents, the esthetic and consumer appeal of the product is favorably improved.

Notwithstanding that the pH of preferred embodiments of compositions according to the present invention are less than 3.0, it has been surprisingly been found that these formulations do not appear to be particularly irritating to the eyes, skin or mucocus tissues of a consumer. Such is a surprising effect as the presence of the acids in the formulation which are beneficial in the removal of hard water stains, as well as the relatively low pH of the formulation would be expected to be a severe irritant to the eyes, skin or mucocus tissues of a consumer.

The compositions according to the invention are useful in the cleaning and/or disinfecting of surfaces, especially hard surfaces, having deposited soil thereon. In such a process, cleaning and disinfecting of such surfaces comprises the step of applying a stain releasing and disinfecting effective amount of a composition as taught herein to such a stained surface. Afterwards, the compositions are optionally but desirably wiped, scrubbed or otherwise physically contacted with the hard surface, and further optionally, may be subsequently rinsed from such a cleaned and disinfected hard surface.

The hard surface cleaner composition provided according to the invention can be desirably provided as a ready to use product in a manually operated spray dispensing container. Such a typical container is generally made of synthetic polymer plastic material such as polyethylene, polypropylene, polyvinyl chloride or the like and includes spray nozzle, a dip tube and associated pump dispensing parts and is thus ideally suited for use in a consumer "spray and wipe" application. In such an application, the consumer generally applies an effective amount of the cleaning composition using the pump and within a few moments thereafter, wipes off the treated area with a rag, towel, or sponge, usually a disposable paper towel or sponge. In certain applications, however, especially where undesirable stain deposits are heavy, the cleaning composition according to the invention may be left on the stained area until it has effectively loosened the stain deposits after which it may then be wiped off, rinsed off, or otherwise removed. For particularly heavy deposits of such undesired stains, multiple applications may also be used.

In a yet a further embodiment, the compositions according to the invention may be formulated so that it may be useful in conjunction with a "aerosol" type product wherein it is discharged from a pressurized aerosol container. If the inventive compositions are used in an aerosol type product, it is preferred that corrosion resistant aerosol containers such as coated or lined aerosol containers be used. Such are preferred as they are known to be resistant to the effects of acidic formulations. Known art propellants such as liquid propellants as well as propellants of the non-liquid form, i.e., pressurized gases, including carbon dioxide, air, nitrogen, hydrocarbons as well as others may be used. Also, while satisfactory for use, fluorocarbons may be used as a propellant but for environmental and regulatory reasons their use is preferably avoided. In such an embodiment, the cleaning composition is dispensed by activating the release nozzle of said aerosol type container onto the stain and/or stain area, and in accordance with a manner as above-described a stain is treated and removed.

Whereas the present invention is intended to be used in the types of liquid forms described, nothing in this specification shall be understood as to limit the use of the composition according to the invention with a further amount of water to form a cleaning solution therefrom. In such a proposed diluted cleaning solution, the greater the proportion of water added to form said cleaning dilution, the greater may be the reduction of the rate and/or efficacy of the thus formed cleaning solution in the cleaning of a hard surface, as well as a reduction in disinfectant efficacy. Accordingly, longer residence times upon the stain to effect their loosening and/or the usage of greater amounts may be necessitated. Conversely, nothing in the specification shall be also understood to limit the forming of a "super-concentrated" cleaning composition based upon the composition described above. Such a super-concentrated composition is essentially the same as the compositions described above except in that they include a lesser amount of water.

While the cleaning compositions are most beneficial for use in their form, i.e., their form as described above, they may also be diluted to form a cleaning composition therefrom. Such cleaning compositions may be easily prepared by diluting measured amounts of the compositions in further amounts of water by the consumer or other end user in certain weight ratios of composition:water, and optionally, agitating the same to ensure even distribution of the composition in the water. The aqueous compositions according to the invention may be used without further dilution, but may also be used with a further aqueous dilution, i.e., in composition:water concentrations of 1:0, to extremely dilute dilutions such as 1:10,000. When subjected to further aqueous dilution, such a dilution is preferably a weight or volume ratio proportion of from 1:10–1:100. The actual dilution selected is in part determinable by the degree and amount of dirt and grime to be removed from a surface(s), the amount of mechanical force imparted to remove the same, as well as the observed efficacy of a particular dilution. Generally better results and faster removal is to be expected at lower relative dilutions of the composition and the water.

Other conventional optional additives, although not particularly elucidated above may also be included in the present inventive compositions.

The following examples below illustrate exemplary formulations of the composition according to the instant invention. It is to be understood that these examples are presented by means of illustration only and that further useful formulations fall within the scope of this invention and the claims may be readily produced by one skilled in the art and not deviate from the scope and spirit of the invention.

Throughout this specification and in the accompanying claims, weight percents of any constituent are to be understood as the weight percent of the active portion of the referenced constituent, unless otherwise indicated.

EXAMPLE FORMULATIONS

Preparation of Example Formulations:

Exemplary formulations illustrating certain preferred embodiments of the inventive compositions and described in more detail in Table 1 below were formulated generally in accordance with the following protocol.

Into a suitably sized vessel, a measured amount of water was provided after which the constituents were added in the following sequence: thickening agent, surfactants, solvents, acid and lastly the coloring and fragrance constituents. All of the constituents were supplied at room temperature, and mixing of the constituents was achieved by the use of a mechanical stirrer with a small diameter propeller at the end of its rotating shaft. Mixing, which generally lasted from 5 minutes to 120 minutes was maintained until the particular exemplary formulation appeared to be homogeneous. The exemplary compositions were readily pourable, and retained well mixed characteristics (i.e., stable mixtures) upon standing for extend periods, even in excess of 120 days.

It is to be noted that the constituents might be added in any order, but it is preferred that water be the initial constituent provided to a mixing vessel or apparatus as it is the major constituent and addition of the further constituents thereto is convenient.

The exact compositions of the example formulations are listed on Table 1, below.

By way of comparison, several comparative formulations were produced as well. These formulations were produced in the same manner as the example formulations of Table I, and they are described in more detail on Table 2, following:

TABLE 2

Comparative Formulations

| Constituent | Comp. 1 | Comp. 2 | Comp. 3 |
|---|---|---|---|
| Poly-Tergent ® SL-62 | 1.00 | 1.00 | 1.00 |
| Rhodapon ® LCP (30%) | 3.00 | 3.00 | 3.00 |
| Ninol ® 11-CM | — | — | — |
| Stepanate ® SCS | — | — | — |
| Polytergent 2A1 (45%) | 3.00 | 3.00 | — |
| Petro LBA | — | — | — |
| Dowanol ® PnB | 3.90 | — | 3.90 |
| Dowanol ® PnP | 0.90 | — | 0.90 |
| Butyl Cellosolve ® Acetate | — | — | — |
| fragrance | 0.20 | 0.20 | 0.20 |
| citric acid | — | 2.50 | 2.50 |
| lactic acid (88%) | — | — | |
| glycolic Acid (70%) | — | 3.57 | 3.57 |
| tartaric Acid | — | — | — |
| deionized water | 88.00 | 86.73 | 84.93 |

The individual constituents which were used to produce the formulations according to Tables 1 and 2 are described in more detail in Table 3, below.

TABLE 1

Example Formulations

| Constituent | Ex.1 | Ex.2 | Ex.3 | Ex.4 | Ex.5 | Ex.6 | Ex.7 | Ex.8 | Ex.9 | Ex.10 |
|---|---|---|---|---|---|---|---|---|---|---|
| Poly-Tergent ® SL-62 | 1.00 | 1.00 | 1.00 | 1.00 | 1.00 | 1.00 | 1.00 | 1.00 | 1.00 | 1.00 |
| Rhodapon ® LCP | 4.17 | 4.17 | 4.17 | 4.17 | 4.17 | 4.17 | 4.17 | 3.00 | 4.17 | 4.17 |
| Ninol ® 11-CM | 0.20 | 0.20 | 0.20 | 0.20 | 0.20 | 0.20 | 0.20 | — | 0.20 | 0.20 |
| Stepanate ® SCS | — | 6.67 | — | — | 6.67 | — | — | — | — | — |
| PoIy-Tergent ® 2A1 | — | — | 3.00 | — | — | 3.00 | 3.00 | 3.00 | 3.00 | — |
| Petro LBA | 3.00 | — | — | 3.00 | — | — | — | — | — | 3.00 |
| Dowanol ® DPnB | 4.00 | 4.00 | 4.00 | 4.00 | 4.00 | 4.00 | 4.00 | — | 4.00 | 4.00 |
| Dowanol ® PnP | 2.00 | 2.00 | — | — | — | 2.00 | — | 0.90 | 2.00 | 2.00 |
| Dowanol ® PnB | — | — | — | — | — | — | — | 3.90 | — | — |
| Butyl Cellosolve ® Acetate | — | — | 2.00 | 2.00 | 2.00 | — | 2.00 | — | — | — |
| citric acid | 2.50 | 2.50 | 2.50 | 2.50 | 2.50 | 2.50 | 2.50 | 2.50 | 2.50 | 2.50 |
| Iactic acid | — | — | — | — | 2.84 | 2.84 | 2.84 | — | — | — |
| glycolic acid | — | 3.57 | — | 3.57 | — | — | — | 3.57 | 3.57 | 3.57 |
| fragrance | — | — | — | — | — | — | — | 0.20 | — | — |
| Kelzan ® T | — | — | — | — | — | — | — | — | — | — |
| tartaric acid | 2.50 | — | 2.50 | — | — | — | — | — | — | — |
| deionized water | 80.63 | 75.89 | 80.63 | 79.56 | 76.62 | 80.29 | 80.29 | 81.93 | 79.56 | 79.56 |

| Constituent | Ex.11 | Ex.12 | Ex.13 | Ex.14 | Ex.15 | Ex.16 | Ex.17 | Ex.18 | Ex.19 | Ex.20 | Ex.21 |
|---|---|---|---|---|---|---|---|---|---|---|---|
| Poly-Tergent ® SL-62 | 1.00 | 1.00 | 1.00 | 1.00 | 1.00 | 1.00 | 1.00 | 1.00 | 1.00 | 1.00 | 1.00 |
| Rhodapon ® LCP | 4.17 | 4.17 | 4.17 | 3.00 | 3.00 | 4.17 | 4.17 | 4.17 | 3.00 | 3.00 | 4.17 |
| Ninol ® 11-CM | 0.20 | 0.20 | 0.20 | — | — | 0.20 | 0.20 | 0.20 | — | — | — |
| Stepanate ® SCS | 6.67 | 6.67 | — | — | — | — | — | 6.67 | — | — | — |
| Poly-Tergent 2A1 | — | — | — | 3.00 | 3.00 | 3.00 | — | — | 3.00 | 3.00 | 3.00 |
| Petro LBA | — | — | 3.00 | — | — | — | 3.00 | — | — | — | — |
| Dowanol ® DPnB | 4.00 | 4.00 | 4.00 | 3.90 | — | — | — | — | 4.50 | 4.00 | — |
| Dowanol ® PnP | 2.00 | — | — | 0.90 | 0.90 | — | — | — | — | 1.00 | — |
| Dowanol ® PnB | — | — | — | — | 3.90 | 2.50 | 2.50 | 2.50 | — | — | 4.00 |
| ButyI Cellosolve ® Acetate | — | 2.00 | 2.00 | — | — | 2.50 | 2.50 | 2.50 | 0.50 | — | 1.00 |
| citric acid | 2.50 | 2.50 | 2.50 | 2.50 | 2.50 | 2.50 | 2.50 | 2.50 | 2.50 | 2.50 | 2.50 |
| lactic acid | — | — | — | — | — | — | 2.84 | 2.84 | — | — | — |
| glycolic acid | — | 3.57 | — | 3.57 | 3.57 | 3.57 | — | — | — | 3.57 | — |
| fragrance | — | — | — | 0.20 | 0.20 | 0.20 | 0.20 | 0.20 | — | — | — |
| Kelzan ® T | — | — | — | — | 0.60 | — | — | — | 1.00 | 0.75 | 0.60 |
| tartaric acid | 2.50 | — | 2.50 | — | — | — | — | — | 2.50 | — | 2.50 |
| deionized water | 76.96 | 75.89 | 80.63 | 81.93 | 81.33 | 80.36 | 81.09 | 77.42 | 82.00 | 81.18 | 81.23 |

TABLE 3

| Constituent Listing | |
|---|---|
| Constituent | |
| Polytergent ® SL-62 | described to be a nonionic alkoxylated linear alcohol surfactant, approx. 8 moles ethoxy per molecule (Olin Chem. Co., Stamford CT) |
| Rhodapon ® LCP | sodium lauryl sulfate (30% actives) (Rhone-Poulenc, Princeton NJ) |
| Ninol ® 11-CM | cocoamide DEA as a foam stabilizer constituent (Stepan Chem. Co., Chicago IL) |
| Stepanate ® SCS | sodium cumene sulfonate (45% actives) as an anionic, hydrotrope |
| Poly-Tergent ® 2A1 | sodium dodecyl diphenyloxide disulfonate (45% actives) as an anionic surfactant/hydrotrope (Olin Chem. Co., Stamford CT) |
| Petro LBA | alkylnaphthalene sulfonate as anionic surfactant/hydrotrope (Witco Corp., New York, NY) |
| Dowanol ® DPnB | dipropylene glycol n-propyl ether as hydrophobic solvent, (Dow Chemical Co., Midland MI) |
| Dowanol ® PnP | propylene glycol n-propyl ether as hydrophilic solvent (Dow Chemical Co., Midland MI) |
| Downaol ® PnB | propylene glycol n-butyl ether as hydrophobic solvent (Dow Chemical Co., Midland MI) |
| Butyl Cellosolve Acetate | ethylene glycol monobutyl ether acetate as hydrophilic solvent (Union Carbide Corp., Danbury CT) |
| citric acid | citric acid, anhydrous USP grade as acid sequestrant |
| lactic acid | lactic acid, USP grade, (88% actives) heat stable as acid seq uestrant |
| glycolic acid | hydroxyacetic acid as acid sequestrant (70% actives) (DuPont Specialty Chemicals, Wilmington DE) |
| fragrance | commercially available fragrance (International Flavors and Fragrances Co., Teterboro NJ) |
| Kelzan ® T | xanthan gum (Kelco Co., San Diego, CA) |
| tartaric acid | USP grade, as acid sequestrant |
| deionized water | deionized water |

Evaluation of Cleaning Efficacy:

Various formulations amongst those listed above were evaluated for their cleaning efficacy on tile surfaces utilizing the following protocols.

Visual Evaluation of Cleaning Efficacy:

Various formulations amongst those listed above were evaluated for their cleaning efficacy by visual inspection by a group of twenty panelists who were asked to observe and rate soil removal on tile surfaces in accordance with the following general protocol.

"Standard soiled tiles" were prepared for use in the tests. First, a test soil composition was prepared which was comprised of the following constituents: 3.90% by weight of a stearic acid based bar soap, 0.35% by weight of a moderate-cleaning shampoo containing alkyl ethoxysulfates and not containing conditioning or treatment additives, 0.06% by weight of ball or black bandy clay, 0.15% by weight of artificial sebum; and 95.54% by weight of deionized water with 2:1 calcium:magnesium, added to give 20,000 ppm total hardness as $CaCO_3$. The test soil composition was prepared by first shaving the bar soap into a suitable container, followed by adding the remaining constituents in the following order: shampoo; clay; sebum and then water. The test soil composition was stirred with three-blade propeller mixer and heated to 45–50° C. and mix until a smooth, lump-free suspension was achieved. Thereafter the suspension was filtered through a Buchner funnel fitted with Whatman #1 filter paper or equivalent, and then the filtrate was resuspended in clean, deionized water, using the same amount of water used to make the test soil composition, and in the same manner, filtered again. The filtrate cake was then removed from the filter paper, and the cake dried overnight at 45° C. After drying, the filtrate cake was pulverized and stored in a dry closed container.

Next, square, 4.5 inch standard black ceramic tiles as the testing substrate were prepared in accordance with the following steps. The ceramic tiles were first cleaned with a commercial light duty liquid dishwashing product; contact with the porous back of the tile was avoided where possible. Next, the tiles were completely rinsed with clean water, and then dried overnight in a 45° C. oven with the face of each tile facing the oven shelf; tiles were placed on paper towels to avoid scratching.

Following the preparation of the test soil composition and the testing substrate, test soiled surface samples were prepared. The test soil composition was reconstituted by combining 4.5% by weight of the test soil composition, 9.00% by weight of hard water as described above, 0.77% by weight of hydrochloric acid (0.1N) and 85.73 of acetone in a in a suitable beaker. Next, these constituents were homogenized and formed into a suspension by mixing until color turned from white to gray, which occurred in about 20–30 minutes. during the mixing process, the beaker was covered as much as possible to avoid excessive solvent, viz., acetone, loss. Subsequently, an appropriate amount of the thus reconstituted test soil composition was loaded into an artist's airbrush set to operate at an air pressure of 40 psi.

The reconstituted test soil composition was applied to the surface of the cleaned and dried tiles prepared as noted above which tiles were placed into rows and columns in preparation for the soil application by visually spraying a uniform amount of soil onto the tiles. Approximately 0.10–0.26 grams of soil was applied per tile. The tiles were then allowed to air dry for a period of 30 minutes, after which each tile was placed on a laboratory hotplate heated to approximately 320° C. until the soil began to visually melt and before the soil began to coalesce into large droplets. Each of the heated tiles was then removed and allowed to cool for approximately 30 minutes. Each of the treated tile surfaces felt sticky to the touch.

Next, a cleaning simulation was performed by the use of a Gardner Washability Apparatus at a standard pressure and sponge stroke settings, to determine or quantify the cleaning efficiency of the formulations. First, and for each new formulation, the sponge was well rinsed with water, then squeezed until all but 17.5±0.5 g of water remained. Next, approximately twelve pumps (approx. 1 gram) of a tested product was sprayed onto the soiled area of one tile, after which the product was allowed to stand 30 seconds on the soil surface of the tile, after which the Garner Apparatus was energized to permit the sponge to pass the tile twelve times on one side of the tile, equivalent to six scrub cyclings of the Apparatus. The tested tile was removed, rinsed with tap water and allowed to dry.

This preparation of standard soiled tiles and cleaning protocol was performed not only for each of the Example formulations, but also for a like number of Comparative formulations which was a commercially available hard surface cleaner composition sold under the trade name "Comet® Bathroom Cleaner" which was used directly from the trigger spray container as a foam in accordance with label directions.

Twenty individuals acted as testing panelists to rate the level of cleaning on a percentage basis (0% to 100% clean) by comparing the cleaned areas of the Example formulations and those areas cleaned by the Comparative formulations as well as the soiled/uncleaned area of the same time. Each of the panelists rated all of the tiles, and in no case were the panelists allowed to discriminate greater than ten percent (i.e.: 10, 20, 30 . . . 100%). The reports determined by the panelists were averaged for each of the evaluated tiles, and the mean reported values for each tile are summarized on Table 4—Visual Cleaning Evaluation, below.

TABLE 4

Visual Cleaning Evaluation

| Example Formulation | Formulation Evaluation Result | Comparative Formulation Evaluation Result |
|---|---|---|
| Ex. 1 | 44 | 36 |
| Ex. 2 | 49 | 45 |
| Ex. 4 | 46 | 41 |
| Ex. 5 | 53 | 29 |
| Ex. 6 | 48 | 34 |
| Ex. 7 | 73 | 51 |
| Ex. 9 | 55 | 39 |
| Ex. 11 | 53 | 47 |
| Ex. 12 | 46 | 39 |

As the results of Table 4 indicate, as well as is shown on FIG. 1, the various formulations generally were determined to be at least comparable in their cleaning efficacy when compared to the known commercial formulation, and in certain cases was found to provide a significant improvement in the cleaning efficacy over that of the prior art commercial cleaning formulation.

Cleaning Evaluation

Cleaning efficacy was measured for the formulation according to Example 8 described in more detail on Table 1 as well as for the three Comparative Examples described on Table 2, above. Evaluation was performed utilizing a Gardner Washability Apparatus, using a standard soil tiles prepared in accordance with the protocol described above at a standard pressure and sponge stroke settings in order to determine or quantify the cleaning efficiency of the formulations. These formulations were used "as is" and were not further diluted to form a cleaning composition therefrom. In determining the cleaning efficiency of each of the formulations, reflectance values were determined using a Gardner Micro-Tri-Gloss Meter which tested each tile at least five times the mean reflectance value being reported below on Table 5. Testing was performed for each of the following: a clean unsoiled tile, a soiled tile, and a soiled tile following Gardner Washability Apparatus scrubbing. Such reflectance values were then employed to calculate % cleaning efficiency according to the following formula:

$$\%\ \text{Cleaning Efficiency} = \frac{Lt - Ls}{Lo - Ls} \times 100\%$$

wherein:

Lt=% reflectance average after scrubbing solid tile;

Ls=% reflectance average before cleaning soiled tile;

Lo=% reflectance average original tile before soiling.

Cleaning efficiency results are shown in Table 5—Cleaning Efficacy, following.

TABLE 5

Cleaning Efficacy

| Composition | % Cleaning Efficiency |
|---|---|
| Example 8 | 63.1 |
| Comp. 1 | 2.1 |
| Comp. 2 | 29.8 |
| Comp. 3 | 19.1 |

As shown, the measurement of the cleaning effectiveness of the test samples involved the ability of the cleaning composition to remove the test soil from the test substrate. This was expressed by % Cleaning Efficiency. As numerical values for a % Cleaning Efficiency increase, higher cleaning effectiveness is achieved for the cleaning composition tested. As the results show, the inventive composition showed an excellent cleaning property.

Figure 2:
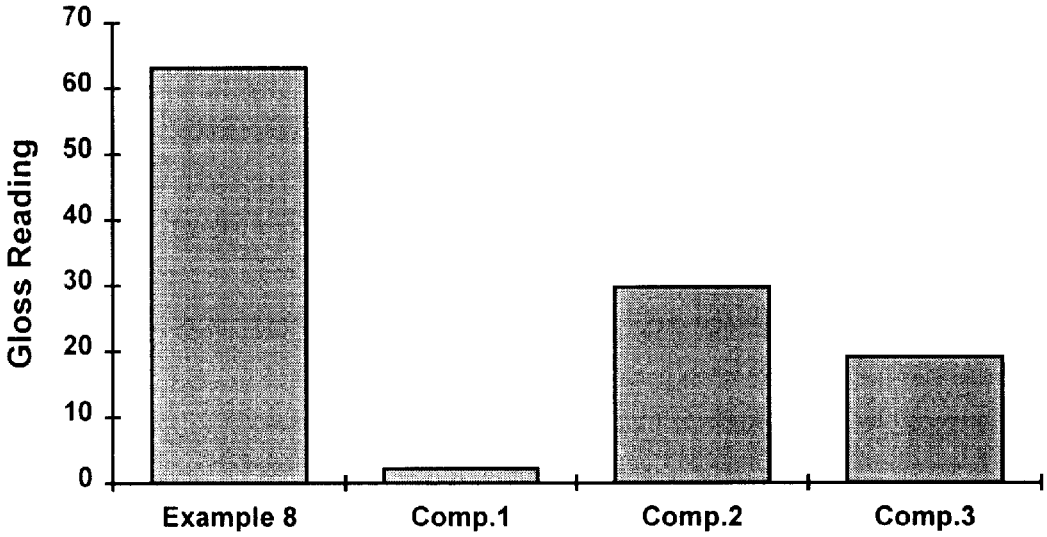
FIG. 2—Illustrates the cleaning efficacy results of table 5.

As a review of the formulations of Ex. 8 are contrasted with those of Comp.1, Comp.2 and Comp.3 it is seen that Comp.1 fails to include the acid sequestrants according to Constituent A, Comp.2 fails to include according to Constituent B, and Comp.3 fails to include Constituent C according to the present invention. As may be seen from the results indicated on Table 5, and as may be further seen from FIG. 2, the compositions according to the invention which include Constituents A, B and C as defined by the present inventors provide a synergistic cleaning effect which is not otherwise provided. This effect may be more clearly seen from FIG. 2 which shows that surprisingly improved cleaning efficacy is provided by the inventive compositions.

Evaluation of Ocular Irritation:

The ocular irritation characteristics of formulations according to the invention were evaluated using the known Draize Eye test protocol. Evaluation was performed on a formulation according to Example 8 of Table 1 above; the pH of this formulation was determined to be 2.0.

As known to those skilled in the art, the Draize Eye Test measures eye irritation for the grading of severity of ocular lesions, measuring three dimensions: scores obtained for the cornea, iris and conjunctiva. For the cornea, after exposure to the composition, A the cornea opacity is graded on a scale from 1 to 4; B the area of cornea involved is graded on a scale from 1–4 (where the score=A×B×5 may be a total maximum of 80). For evaluation of the iris, after exposure the composition, A the involvement of the iris is graded on a scale of 1–2 (where the score=A×5 may be a total maximum of 10). For a evaluation of the conjunctive, A Redness is graded on a scale of 1–3; B Chemosis is graded on a scale of 1–4; and C Discharge is measured on a scale of 1–3 [where the score=(A+B+C)×2 may be a maximum of 20]. The maximum total score is the sum of all scores obtained for the cornea, iris and conjunctive (a maximum of 110).

During the performance of the Draize test, the Draize test score on day 1 of the test was 11.33, and it was further observed that all signs of conjunctival irritation of all 6 subjects cleared by day 7. The results of the Draize test indicated that an EPA classification Category III was appropriate, where corneal involvement or irritation cleared in seven (7) days or less.

Within the guidelines of the Environmental Protection Agency (EPA), 40 C.F.R. Ch. 1, § 162.10, (1986), based on the Draize Eye Test results, the formulation tested was determined to have a EPA classification Category III, where corneal involvement or irritation cleared in seven (7) days or less. This category requires only the presence of a "caution" warning with an accompanying appropriate first aid statement, does not require the use of any safety clothing, does not require child resistant closure as regulated by the EPA, and thus presents a marketing advantage of the composition. That these results are achieved with a product showing good cleaning efficacy, and has an acidic pH of the order described above, particularly the acidic pH's within the scope of the preferred compositions is especially surprising.

The preceding evaluations were repeated again, but using the formulation according to Example 13, described on Table 1. The pH of this formulation was evaluated prior to each test and determined to be 2.0. During the performance of the Draize test, the Draize test score on day 1 of the test was 16.5, and it was observed that corneal opacity was exhibited by only 3 of 6 subjects, which nonetheless cleared by the third day. Iritsis was observed in 4 of the 6 subjects, which cleared in these subjects by the second day. All signs of conjunctival irritation of all 6 subjects cleared by day 7. The results of the Draize test indicated that an EPA classification Category III was appropriate, where corneal involvement or irritation cleared in seven (7) days or less. As noted previously, the use of a "caution" warning with an accompanying appropriate first aid statement is appropriate, and packaging does not require child resistant closure as regulated by the EPA, presenting a marketing advantage of the composition. That these results are achieved with a product showing good cleaning efficacy, and having an acidic pH of 2.0 is again, particularly surprising.

Evaluation of Dermal Irritation:

The effect of the formulation according to Example 8 of Table 1 was also evaluated for skin irritation; prior to the test the pH of the formulation was determined to be 2.0. The formulation of Example 8 of Table 1 was used "as is", that is to say without further dilution in water.

Evaluation of skin irritation was performed in accordance with the following protocol. As test animals, one group of young adults 6 New Zealand White rabbits weighing 2.0–3.5 kg with no differentiation as to their sex were collected. Prior to application of the testing, the back and sides of each animal are clipped free of hair. Two sites, one on each side of the spinal column, are selected and remain intact. Each study animal is fitted with an Elizabethan style restraining collar prior to dosing. Next, the test formulation was introduced under a 2.5 cm sq. gauze patch. The patches were applied to two intact sites/animal, and were secured with adhesive tape; the test sites were not occluded. The test formulation was kept in contact with the skin for 4 hours at which time the wrappings were removed and the sites were rinsed with 100 ml of tap water. The restraining collars were removed at this time.

In vivo evaluation of the rabbits was performed by observing for skin reactions, including ulceration & necrosis, at 4, 24 and 72 hours after application of the test article. Scoring is based on the following scale:

| | |
|---|---|
| Erythema | |
| No erythema | 0 |
| Very slight erythema (barely perceptible) | 1 |
| Well-defined erythema | 2 |
| Moderate to severe erythema | 3 |
| Severe erythema (beet redness) to slight eschar formation (injuries in depth) | 4 |
| Edema | |
| No edema | 0 |
| Very slight edema (barely perceptible) | 1 |
| Slight edema (edges of area well-defined by definite raising) | 2 |
| Moderate edema (raised approx. 1 mm) | 3 |
| Severe edema (raised more than 1 mm and extending beyond the area of exposure) | 4 |
| Any signs of corrosivity | >4 |

Mean Scores are determined by adding the scores of erythema/eschar on both sites and the scores for edema on both sites are added. Each of the resulting 4 sums is divided by 6 (number of animals) to obtain the 4 mean scores for each single time period. Determination of the Primary Irritation Index is obtained by adding the 4 mean scores for the 24 and 72 hour scores (a total of 8 values) and dividing the sum by 4 (2 sites×2 time periods) to obtain the Primary Irritation Index. A Primary Irritant is defined as a substance which is not corrosive, but which results in an empirical score of 5 or more, in accordance with 16 Code of Federal Regulations §1500.3 (c)(4).

As a result of the test protocol, it was found that the formulation according to Example 8 of Table 1 caused no irritation as determined by observations in the tested subjects for 72 hours notwithstanding the acidic pH of the formulation.

Evaluation of Antimicrobial Efficacy:

Several of the exemplary formulations described in more detail on Table 1 above were evaluated in order to evaluate their antimicrobial efficacy against *Staphylococcus aureus* (gram positive type pathogenic bacteria) (ATCC 6538), *Salmonella choleraesuis* (gram negative type pathogenic bacteria) (ATCC 10708), and *Pseudomonas aeruginosa* (ATCC 15442). The testing was performed in accordance with the protocols outlined in "Use-Dilution Method", Protocols 955.14, 955.15 and 964.02 described in Chapter 6 of "Official Methods of Analysis", 16$^{th}$ Edition, of the Association of Official Analytical Chemists; "Germicidal and Detergent Sanitizing Action of Disinfectants", 960.09 described in Chapter 6 of "Official Methods of Analysis", 15th Edition, of the Association of Official Analytical Chemists; or American Society for Testing and Materials (ASTM) E 1054–91 the contents of which are herein incorporated by reference. This test is also commonly referred to as the "AOAC Use-Dilution Test Method".

As is appreciated by the skilled practitioner in the art, the results of the AOAC Use-Dilution Test Method indicates the number of test substrates wherein the tested organism remains viable after contact for 10 minutes with at test disinfecting composition/total number of tested substrates (cylinders) evaluated in accordance with the AOAC Use-Dilution Test. Thus, a result of "0/60" indicates that of 60 test substrates bearing the test organism and contacted for 10 minutes in a test disinfecting composition, 0 test substrates had viable (live) test organisms at the conclusion of the test. Such a result is excellent, illustrating the excellent disinfecting efficacy of the tested composition.

Results of the antimicrobial testing are indicated on Table 6, below. The reported results indicate the number of test cylinders with live test organisms/number of test cylinders tested for each example formulation and organism tested.

TABLE 6

| | Antimicrobial Efficacy | | |
|---|---|---|---|
| | *Staphylococcus aureus* | *Salmonella choleraesuis* | *Pseudomonas aeruginosa* |
| Example Formulation | | | |
| Ex. 15 | 0/60 | 0/60 | 0/60 |
| Ex. 17 | 0/60 | — | 0/60 |
| Ex. 8 | 0/60 | — | 0/60 |

"—" indicates not tested

As may be seen from the results indicated above, the compositions according to the invention provide excellent cleaning benefits to hard surfaces, including hard surfaces with difficult to remove stains yet at the same time they are surprisingly mild to skin and the mucous tissues of the user which is uncharacteristic of cleaning compositions which include any significant proportion of an acidic constituent. These advantages are further supplemented by the excellent antimicrobial efficacy of these compositions against known bacteria commonly found in bathroom, kitchen and other environments and still further, the efficacy of these compositions against the polio virus as well. Such advantages clearly illustrate the superior characteristics of the compositions, the cleaning and antimicrobial benefits attending its use which is not before known to the art.

While described in terms of the presently preferred embodiments, it is to be understood that the present disclosure is to be interpreted as by way of illustration, and not by way of limitation, and that various modifications and alterations apparent to one skilled in the art may be made without departing from the scope and spirit of the present invention.

We claim:

1. An aqueous hard surface cleaning and disinfecting composition which comprises:

4–6% by weight of an acid sequestrant constituent which comprises citric acid and an acid selected from lactic, glycolic and tartaric acids;

3–6% by weight of a mixture of hydrophobic and hydrophilic solvents where said hydrophobic solvent exhibits a solubility in water of from 0.0–20.0 ml per 100 ml of water, which comprises 50–99% wt. of said mixture of solvents and which is selected from the group: mineral spirits, tripropylene glycol n-butyl ether, propylene glycol phenyl ether, dipropylene glycol n-butyl ether, ethylene glycol phenyl ether, propylene glycol n-butyl ether, dipropylene glycol n-butyl ether, and mixtures thereof, and wherein said hydrophilic solvent comprises 1–50% wt. of said mixture of solvents, said hydrophilic solvent selected from the group: glycol methyl ether, dipropylene glycol methyl ether, tripropylene glycol methyl ether, propylene glycol n-propyl ether, ethylene glycol n-butyl ether, diethylene glycol n-butyl ether, diethylene glycol methyl ether, propylene glycol, ethylene glycol, isopropanol, ethanol, methanol, diethylene glycol monoethyl ether, ethylene glycol mono-butyl ether acetate, diethylene glycol monoethyl ether acetate, and mixtures thereof;

1–4% wt. of a single constituent which exhibits both anionic surfactant and hydrotrope properties selected from the group: alkyl phenoxybenzene disulfonates and alkyl naphthalene sulfonates;

0–20% by weight of one or more optional constituents; and the balance to 100% by weight, water wherein the aqueous hard surface cleaning and disinfecting composition exhibits a pH of 7.0 or less.

2. The aqueous hard surface cleaning composition according to claim 1 wherein the acid sequestrant constituent comprises at least 50% by weight of citric acid.

3. The aqueous hard surface cleaning composition according to claim 1 wherein the single constituent which exhibits both anionic surfactant and hydrotrope properties is present in an amount of from 2.0–4.0% by weight.

4. The aqueous hard surface cleaning composition according to claim 1 which includes an optional constituent selected from: nonionic surfactants, foaming agents, foam stabilizers, coloring agents, fragrances (whether natural or synthetically produced), fragrance adjuvants and/or fragrance solubilizers, viscosity modifying agents, thickeners, gelling agents, pH adjusting agents, pH buffers, antioxidants, water softening agents, further solubilizing agents useful in the solubilization of one or more of the constituents in water, and, preservative compositions.

5. The aqueous hard surface cleaning composition according to claim 1 wherein the pH of the composition is from about 5.0 to about 1.0.

6. The aqueous hard surface cleaning composition according to claim 5 wherein the pH of the composition is from about 4.0 to about 1.0.

7. The aqueous hard surface cleaning composition according to claim 6 wherein the pH of the composition is from about 3.0 to about 1.0.

8. The aqueous hard surface cleaning composition according to claim 1 which comprises a gelling agent, and said composition is in a gelled form.

9. A disinfecting aqueous hard surface cleaning and disinfecting composition according to claim 1 which is effective against gram positive type pathogenic bacteria.

10. A disinfecting aqueous hard surface cleaning and disinfecting composition according to claim 1 which is effective against gram negative type pathogenic bacteria.

11. A method of cleaning and disinfecting a hard surface which comprises: applying to the surface a stain releasing and disinfecting effective amount of a composition comprising:

from about 0.1–10% by weight of an acid sequestrant constituent which comprises citric acid, and an acid selected from lactic, glycolic, and tartaric;

from about 0.1 to about 10% by weight of a mixture of hydrophobic and hydrophilic solvents where said hydrophobic solvent exhibits a solubility in water of from 0.0–20.0 ml per 100 ml of water, which comprises 50–99% wt. of said mixture of solvents and which is selected from: mineral spirits, tripropylene glycol n-butyl ether, propylene glycol phenyl ether, dipropylene glycol n-propyl ether, ethylene glycol phenyl ether, propylene glycol n-butyl ether, dipropylene glycol n-butyl ether, and mixtures thereof, and wherein said hydrophilic solvent comprises 1–50% wt. of said mixture of solvents, said said hydrophilic solvent selected from the group: glycol methyl ether, dipropylene glycol methyl ether, tripropylene glycol methyl ether, propylene glycol n-propyl ether, ethylene glycol n-butyl ether, diethylene glycol n-butyl ether, diethylene glycol methyl ether, propylene glycol, ethylene glycol, isopropanol, ethanol, methanol, diethylene glycol monoethyl ether, ethylene glycol mono-butyl ether acetate, diethylene glycol monoethyl ether acetate, and mixtures thereof;

from about 1 to about 8% by weight of a single constituent which exhibits both anionic surfactant and hydrotrope properties selected from the group: alkyl phenoxybenzene disulfonates and alkyl naphthalene sulfonates;

0–20% by weight of one or more optional constituents; and the balance to 100% by weight, water wherein the aqueous hard surface cleaning and disinfecting composition exhibits a pH of 7.0 or less; and, wiping said composition off said surface.

* * * * *